US005202530A

United States Patent [19]

Stephens

[11] Patent Number: 5,202,530

[45] Date of Patent: Apr. 13, 1993

[54] LIGHT ARMOR PIERCING AUTOMATIC RIFLE

[76] Inventor: Mark L. Stephens, 546½ N. 5th St., Upland, Calif. 91786

[21] Appl. No.: 864,270

[22] Filed: Apr. 6, 1992

[51] Int. Cl.[5] ..... F41A 1/04; F41A 13/00

[52] U.S. Cl. ..... 89/7; 89/14.1; 89/14.2; 89/14.3; 89/33.02; 89/33.03; 89/33.05; 89/155; 89/191.01; 42/74; 102/376

[58] Field of Search ..... 89/7, 14.1; 102/376, 102/440

[56] References Cited

U.S. PATENT DOCUMENTS

| | | | |
|---|---|---|---|
| H 403 | 1/1988 | Glasser | 102/376 |
| 1,269,574 | 6/1918 | Anthony et al. | 89/7 |
| 2,376,321 | 5/1945 | Albertson | 89/14.1 |
| 3,969,978 | 7/1976 | Seifert et al. | 89/7 |
| 4,005,632 | 2/1977 | Holtrop | 89/7 |
| 4,197,800 | 4/1980 | Greever et al. | 102/376 |
| 4,915,010 | 4/1990 | Bleickert et al. | 89/7 |

FOREIGN PATENT DOCUMENTS

| | | | |
|---|---|---|---|
| 100408 | of 1918 | United Kingdom | 89/7 |
| 560813 | 4/1944 | United Kingdom | 89/7 |

*Primary Examiner*—Stephen C. Bentley
*Attorney, Agent, or Firm*—Daniel L. Dawes

[57] ABSTRACT

A light armor piercing weapon, which is hand carried by a single man, is provided for firing or launching armor piercing rocket propelled projectiles. A propellent pack is worn or carried by the soldier along with a launching rifle. Unsymmetrical dimethylhydrazine is provided as a propellent and inhibited red fuming nitric acid, Type IIIa, is provided as an oxidant in a combustion chamber in the rifle. The explosive combination of the propellent and oxidant propels the projectile out of a smooth bore barrel and simultaneously ignites the solid propellent in the projectile. The projectile is provided with a disposable sabot which seals the projectile within the smooth bore. The projectile is provided from a spiral drum magazine which is gear driven by a mechanical coupling with a reciprocating breech block within the rifle. The reciprocating breech block in turn is gear driven by a gas driven piston communicated with the barrel. A ramming rod is also gas driven from the barrel to dispose the projectile into the breech block synchronously with reciprocation of the block. Coolant in a closed loop cooling system is pumped through the rifle by the reciprocating action of the breech block, which has pumping chambers which are effective upon reciprocation of the block. The coolant is used to cool the breech block and the combustion chamber within the rifle. Excess heat from the coolant is transferred to the ambient environment by an air-to-coolant heat exchanger carried in the propellent pack. The rifle butt is provided with a hydraulic recoil shock absorber. The barrel is provided with a muzzle brake and flash hider. The initial round is mechanically cocked and a manual unloading mechanism is provided to eject an unlaunched projectile.

19 Claims, 5 Drawing Sheets

LIGHT ARMOR PIERCING AUTOMATIC RIFLE

BACKGROUND OF THE INVENTION

1. Field of the Invention

The invention relates to the field of hand carried weapons, and in particular to light armor piercing rifles utilizing rocket propelled projectiles. The invention specifically relates to the operation of a bolt in such a gun with a coolant system, which bolt includes a reciprocating motion acting in cooperation with a drum magazine, a cocking, loading, and an unloading mechanism.

2. Description of the Prior Art

Rifles using liquid propellents and fluidic cooling are well known. One example is shown by Elmore et al., "*Liquid Propellent Modular Gun Incorporating Dual Cam Operation and Internal Water Cooling,*" U.S. Pat. No. 4,062,266 (1977). Elmore shows a liquid propellent gun in which liquid propellent is burned in the combustion chamber to fire a projectile. The gun is externally driven by a motor and uses an internal water cooling system which injects a small quantity of water into the combustion chamber for cooling by internal vaporization. Elmore, however, requires a source of cooling fluid which is expendable since there is no recirculation of the cooling fluid and also a large source of electrical power to drive the motor driven gun mechanism.

An even earlier version of the liquid propellent gun is shown in Elmore et al., "*Liquid Propellent Weapon,*" U.S. Pat. No. 3,803,975 (1974). However, Elmore '975 used a single propellent type which tends to be inherently unstable and dangerous.

An additional example of a rocket fired gun or saboted rifle as shown by Fansler et al., "*Silencer for Saboted Projectiles,*" U.S. Pat. No. 4,928,573 (1990) and by Kruzell, "*Closed Breech Rocket Gun,*" U.S. Pat. No. 3,227,045 (1966). However, neither one of these prior examples contemplate the use of multiple, injected propellents which are combined in a combustion chamber.

While most gun systems, which have cooling systems, contemplate an open system in which the cooling fluid is not recirculated or retained, some prior art examples of closed circuit cooling systems are known. Refrigerated systems have been used as early as 1906, such as shown in Otto, British specification 13,321 (1906). The use of a compressor in a refrigerated cooling system is operated by expansion gases created in the gun are shown by German Patent 487,229 (1929). Use of heat exchanging coils in connection with gun barrel cooling is also exhibited by German Patent 321,149 (1920).

Notwithstanding the prior efforts which have been expended both on liquid propellent guns and on guns utilizing refrigeration cooling, no small, portable liquid propellent rifle has yet been designed which can provide rapid, automatic firing of liquid propellent fired rocket projectiles in a package that can be carried by a single man and be handled by hand.

BRIEF SUMMARY OF THE INVENTION

The invention is a liquid propellent gun for the launching of rocket propelled projectiles comprising a rifle for launching the projectiles. The rifle comprises a barrel through which the projectiles are launched and a combustion chamber coupled to the barrel for igniting and launching the projectiles through the barrel. A propellent pack provides a plurality of liquid propellent components to the rifle for combination within the combustion chamber. As a result, high velocity projectiles are launched from a light weight gun. The propellent pack provides a liquid propellent and a liquid oxidant for controlled combination within the combustion chamber. The propellent component is unsymmetrical dimethylhydrazine and the oxidant is inhibited red fuming nitric acid.

The invention further comprises a cooling system for cooling the combustion chamber within the rifle. The cooling system is a closed loop system. The closed loop cooling system is comprised of a pump within the rifle, and a closed circuit at least partly within the rifle. The closed circuit is in heat exchanging relationship with the combustion chamber. A liquid cooling fluid is disposed in the closed circuit and is pumped therethrough by the pump. A heat exchanging subsystem transfers heat out of the cooling fluid. The heat exchanging subsystem is disposed within the propellent pack. The heat exchanging subsystem includes an air-to-cooling fluid heat exchanger.

The rifle further comprises a reciprocating block having a breech defined therein. The projectiles are disposed within the breech and launched therefrom through the barrel. The reciprocating block has at least one piston chamber defined therein. The reciprocating block and piston chamber comprising the pump.

The gun further comprises a reciprocating piston operatively communicated with the barrel for the supplying gas pressure from the barrel to drive the piston. The gas driven piston is coupled to the block to cause the block to reciprocate.

The rifle mechanism further comprises a gas driven loading rod for disposing the projectiles into the breech of the block. The loading rod is operatively communicated with the barrel to provide gas pressure for driving the loading rod.

The gun still further comprises a cocking mechanism for manually disposing one of the projectiles into the breech of the block and for reciprocating the block from a loading position to a launching position.

The gun further comprises an unloading mechanism for manually disposing one of the projectiles from the breech of the block from the rifle mechanism without launch of the projectile.

The rifle mechanism further comprises a spiral magazine for storing a plurality of the projectiles. The spiral magazine comprises a drum casing in which the plurality of projectiles are slidingly disposed in a spiral pattern. A push rod urges the spiral pattern of projectiles from the drum casing. A motive mechanism is coupled to the push rod for applying a force to the push rod to urge the projectiles from the magazine. The motive mechanism is coupled to the reciprocating block so that advancement of one of the projectiles from the spiral magazine into the rifle mechanism is synchronized with motion of the reciprocating block.

The rifle mechanism further comprises a butt. The butt includes a fluidic shock absorbing mechanism for absorbing recoiled energy and parted to the rifle mechanism by launch of the projectile.

The rifle further comprises muzzle brake coupled to the barrel so that escaping gas from the barrel into the muzzle brake generates a braking force opposing recoil of the rifle upon launch of the projectile. The muzzle brake further comprises flash hiding mechanism for visually hiding flash of gas escaping from the barrel upon launch of the projectile from the rifle.

The invention is also characterized as a method for launching rocket propelled projectiles in a hand held gun comprising the steps of feeding a projectile from a magazine into a breech of a reciprocating block. The block is disposed into a launching position adjacent a combustion chamber. The combustion chamber within the gun is provided with a plurality of liquid propellent components. The liquid propellent components, when being combined, violently explode within the combustion chamber. The rocket-propelled projectile is simultaneously ignited and projected from the combination chamber through a barrel of the gun. As a result, high velocity projectiles are launched from a light hand held rifle.

The invention can better be visualized by now turning to the following drawings.

The invention and its various embodiments may be better understood by now turning to the following detailed description.

DETAILED DESCRIPTION OF THE PREFERRED EMBODIMENTS

A light armor piercing weapon, which is hand carried by a single man, is provided for firing or launching armor piercing rocket propelled projectiles. A propellent pack is worn or carried by the soldier along with a launching rifle. Unsymmetrical dimethylhydrazine is provided as a propellent and inhibited red fuming nitric acid, Type IIIa, is provided as an oxidant in a combustion chamber in the rifle. The explosive combination of the propellent and oxidant propels the projectile out of a smooth bore barrel and simultaneously ignites the solid propellent in the projectile. The projectile is provided with a disposable sabot which seals the projectile within the smooth bore. The projectile is provided from a spiral drum magazine which is gear driven by a mechanical coupling with a reciprocating breech block within the rifle. The reciprocating breech block in turn is gear driven by a gas driven piston communicated with the barrel. A ramming rod is also gas driven from the barrel to dispose the projectile into the breech block synchronously with reciprocation of the block. Coolant in a closed loop cooling system is pumped through the rifle by the reciprocating action of the breech block, which has pumping chambers which are effective upon reciprocation of the block. The coolant is used to cool the breech block and the combustion chamber within the rifle. Excess heat from the coolant is transferred to the ambient environment by an air-to-coolant heat exchanger carried in the propellent pack. The rifle butt is provided with a hydraulic recoil shock absorber. The barrel is provided with a muzzle brake and flash hider. The initial round is mechanically cocked and a manual unloading mechanism is provided to eject an unlaunched projectile.

Figure 1A:
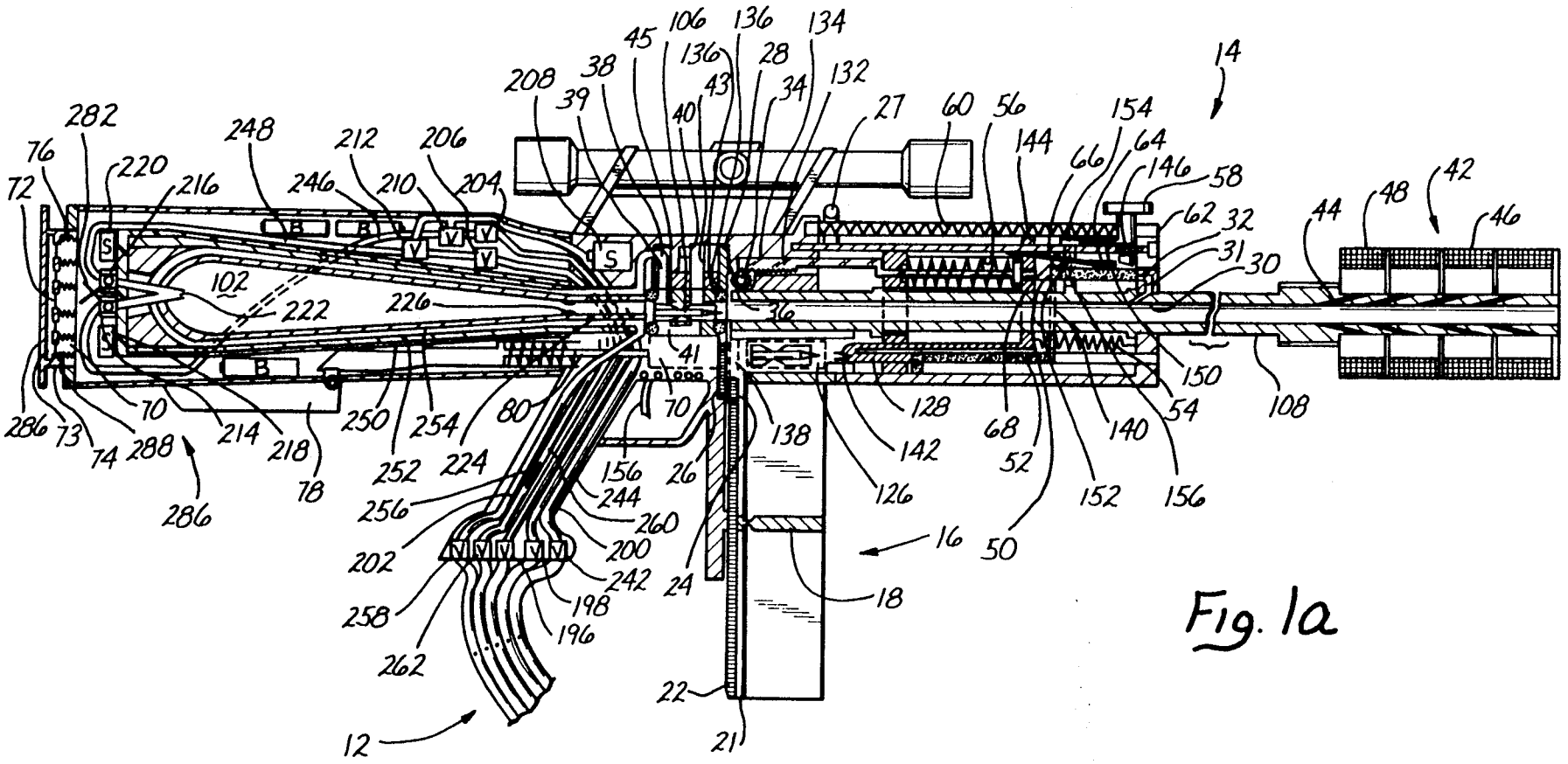
FIG. 1*a* is a diagrammatic cross-sectional view of a rifle incorporating the invention capable of firing multiple rounds of a saboted projectile.
Figure 1B:
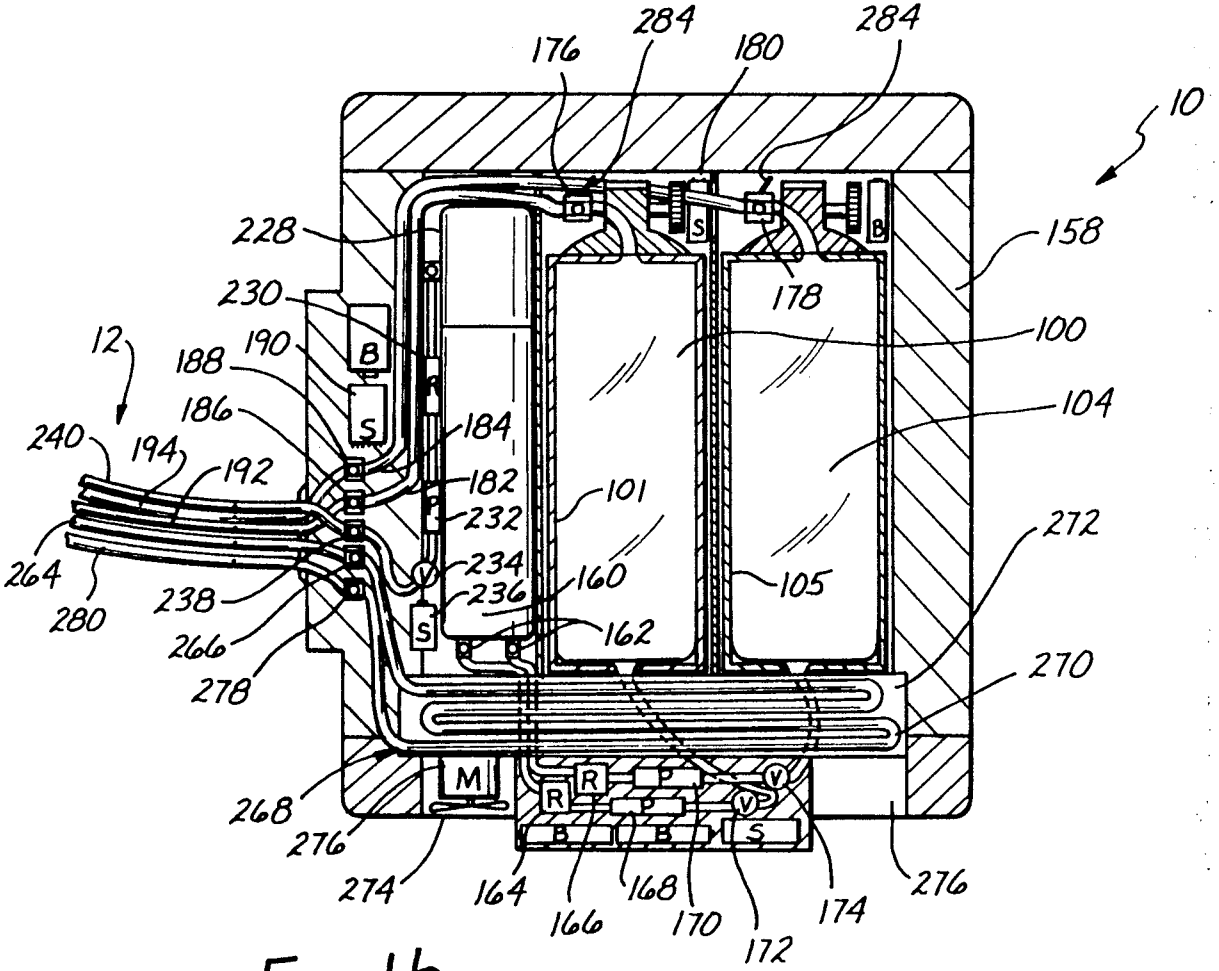
FIG. 1*b* is a diagrammatic cross-sectional view of a propellant pack for the rifle of FIG. 1*a*.
Figure 1C:
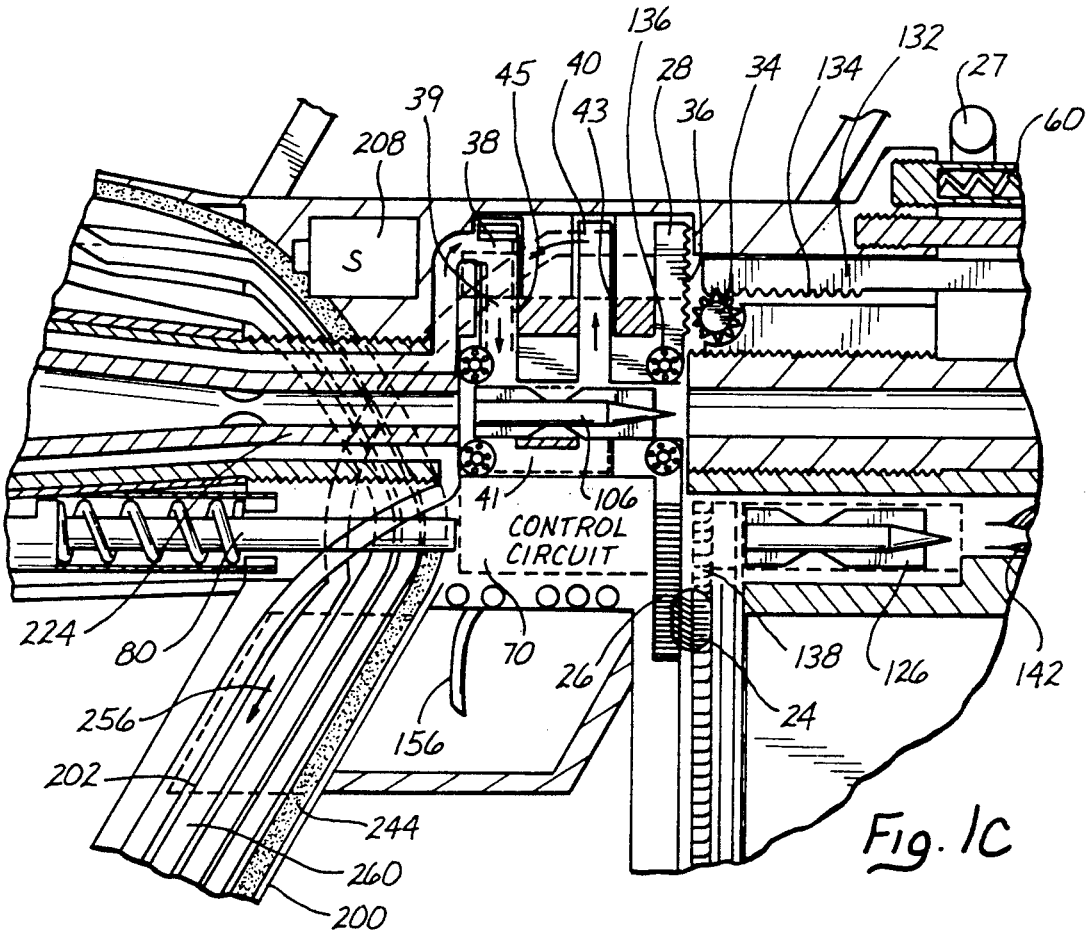
FIG. 1*c* is an enlargement of a portion of FIG. 1*a* showing the breech mechanism and surrounding elements in greater clarity.
Figure 1D:
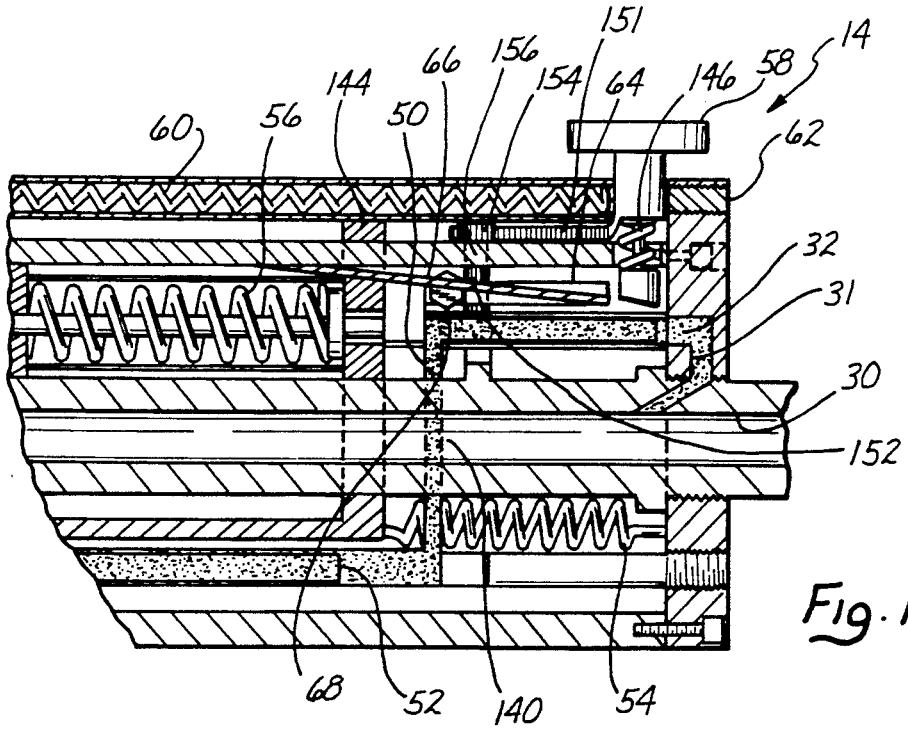
FIG. 1*d* is an enlargement of a portion of FIG. 1*a* showing the cocking mechanism and surrounding elements in greater clarity.

FIGS. 1*a* and 1*b* are simplified cross-sectional views showing the elements of a light armor piercing rifle that is capable of automatic, semiautomatic, or single shot fire control of multiple rounds of armor piercing, rocket propelled projectiles launched by multiple propellants. The gun system is comprised of two major components, a propellent pack 10 shown in FIG. 1*b* and a rifle body 14 shown in FIG. 1*a*. Propellent pack 10 is coupled to rifle body 14 by a plurality of hoses 12 shown in FIG. 1*b*. Pack 10 is worn by the soldier on his back so that the system is carried by a single person. In the preferred embodiment, unsymmetrical dimethylhydrazine (UDMH) in liquid form is provided from a first tank 100 and combined in the gun in a combustion chamber 102 with inhibited red fuming nitric acid, type III-A, (oxidizer) which is stored within a second tank 104. When propellent UDMH from tank 100 is combined with oxidizer from tank 104 in combustion chamber 102, a forcible explosion occurs which propels a projectile 106 out of a smooth bore barrel 108. In addition, combustion in chamber 102 ignites solid propellent 110 contained within projectile 106 as shown in FIG. 4.

Figure 4:
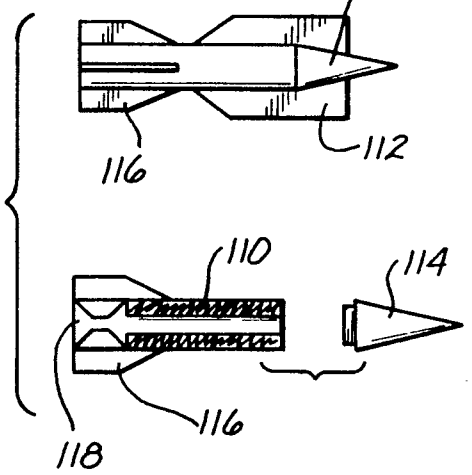
FIG. 4 shows a projectile in side elevational view with a sabot, and another projectile in cross-sectional side view.

Turning now to FIG. 4, projectile 106 is provided with a disposable sabot 112 which disintegrates within the first few feet of travel from gun barrel 108. Projectile 106 includes an armor piercing point 114, stabilizing fins 116 and a nozzle 118 for providing enhanced thrust for ignited solid propellent 110. The muzzle velocity of projectile 106 from rifle body 14 is extremely high and armor piercing nose cone 114 is able to penetrate light armor at the distance of one-half mile or more. A conventional telescopic sight or other aiming or guidance device is mounted on rifle body 14 for fire control.

Figure 2:
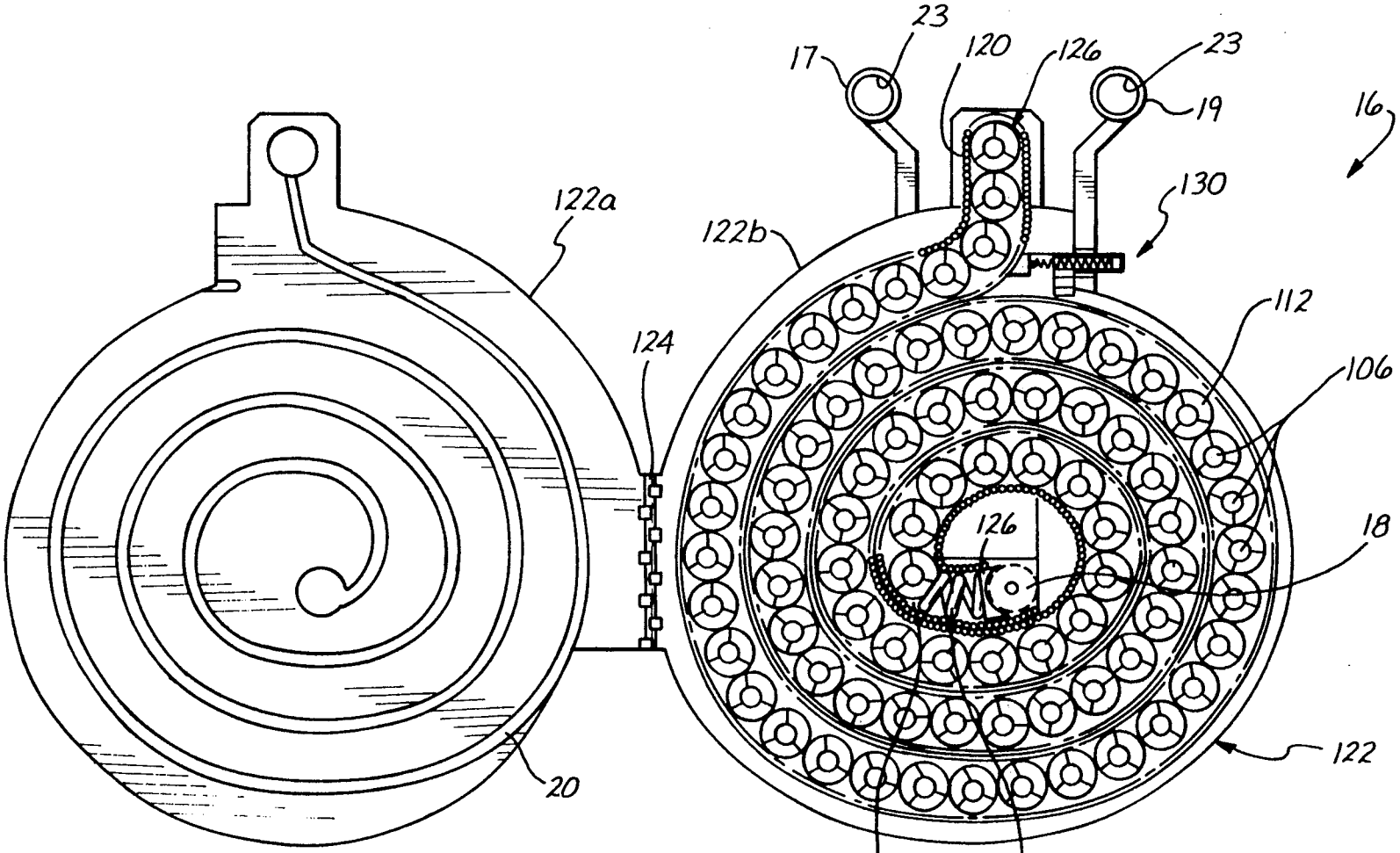
FIG. 2 is a plan view of the drum magazine of FIG. 1*a* shown in isolation of the other elements of the gun and shown with the lid opened.

The major elements of rifle body 14 now having been briefly considered, turn and consider in more detail drum magazine 16 shown in side view in FIG. 1*a* and in isolated plan view in open configuration in FIG. 2. Drum magazine 16 is comprised of a spiral track of rollers 120 for guiding projectiles 106, which are held within spirally shaped guide ways in drum 16. Rollers 120 may be comprised, for example, of roller pin bearings captured within a spiral raceway or matrix. Rollers 120 guide and provide rolling friction against sabot 112 for each projectile 106. As shown in FIG. 2, projectiles 106 in the illustrated embodiment are laid out in a clockwise spiral within a generally cylindrical drum 16 as seen from the front of the gun(the right in FIG. 1*a*).

A push rod 18 seen in FIG. 2 rides in a groove 20 defined in the inner surfaces of both halves of a magazine casing 122. Spiral groove 20 is shown in FIG. 2 only in the upper half casing **122*a* which is connected by means of a hinge 124 to the lower half casing 122*b*. Front cover 122*a* closes and latches on opposing portion 122*b* of casing 122 and is locked in position by a spring-loaded latching mechanism generally denoted by reference numeral 130. Push rod 18 seats against a retainer block 126 which in turn bears against a coil spring 129 whose opposing end bears against a receiving block 130. Receiving block 130 has an opposing surface which is adapted to conform to sabot 112 of projectile 120**.

Push rod 18 is moved by a rotating rod 21 illustrated in FIG. 1*a* which is slidingly coupled to push rod 18. Push rod 18 begins at an off center position such as shown in FIG. 2. As rod 21 rotates in the plane of FIG. 2 (rod 21 is shown only in FIG. 1*a*) it will move push rod 18 clockwise along the spiral groove. The sliding engagement of push rod 18 with rotating rod 21 allows push rod 18 to move outwardly along the spiral as it makes multiple rotations within drum 16.

Rotating rod 21 is rotated by a rack and gear mechanism. A rack 22 is driven by a gear 24. Gear 24 in turn is driven by a rack 26 which form part of a reciprocating bolt 28. Rod 21 which is coupled to rack 22 by a drive gear includes a ratcheting mechanism so that it is rotated only in one direction, namely the clockwise direction which will advance push rod 18. Bolt 28 reciprocates vertically in the depiction of FIG. 1 as will be described below. This reciprocating motion is ultimately coupled to rack 22 and converted into an intermittent or ratcheting rotation of rod 21.

Projectiles 106 are collectively moved along within the spiral track of drum 16 to a delivery position denoted by reference numeral 126. When projectile 106 is in the delivery position 126, it is positioned as shown in FIG. 1*a* in a location ready for movement by ramming pin 128 from delivery position 126 into vertically reciprocating bolt 28.

Consider now operation of the bolt chamber. When a projectile 106 is fired, gas from barrel 108 escapes through a bleed port 30 as shown in FIG. 1*a* to the end of a piston 32 through a connecting chamber 31. Piston 32 in FIG. 1*a* is an integral piece which extends rearwardly (to the left in FIG. 1*a*) within the cocking mechanism to an end portion 132 having a gear rack 134 defined therein. Gas pressure will cause piston 32 to move to the left in FIG. 1*a* against the force of compression spring 56 thereby turning gear wheel 34. Gear wheel 34 in turn will drive rack 36 which is formed on part of bolt 28. Although not shown in FIG. 1*a*, it must be understood that appropriate offsets or cutouts are provided in bolt 28 to allow the clearance of end portion 132 of piston 32 as it moves to the left within the cocking mechanism.

Bolt 28, which is carried on roller bearings 136, will then be driven downward to position breech 138 behind loading position 126 thereby allowing the next projectile 106 to be inserted into breech 138. Breech 138 and surrounding elements are better visualized in the enlargement depicted in FIG. 1*c*.

After the face of piston 32 has cleared gas port 50, pressurized gas is then delivered via duct 140 to the face of actuator piston 52. Actuator piston 52 is then driven to the left as shown in FIG. 1 against an extension spring 54. It should be noted that piston 32 passes through a hole inside a top portion of actuator 52 so that it must be understood that except for gas coupling, piston 32 and actuator 52 reciprocate to the left and right in FIG. 1*a* without mechanical interconnection. In any case, as piston actuator 52 is moved to the left in FIG. 1, ramming pin 128 is brought into contact with nose cone 114 of projectile 106 thereby driving projectile 106 into an open and waiting empty breech 138 which has been position in a receiving position when bolt 28 is driven downwardly by the leftward movement of piston 32.

Actuator piston 52 also includes a vertically extending arm 144 which passes around barrel 108. Arm 144 is used in the cocking of the very first round to be fired prior to the existence of any gas pressure within barrel 108. The cocking mechanism and surrounding elements are better illustrated in enlarged view in FIG. 1*d*. To cock the first round, it is necessary to pull back (to the left in FIG. 1*a*) on cocking handle 58. Cocking handle 58 bears against a compression spring 60 and slides along the slot within the plane of FIG. 1*a*. Telescopically disposed on the lower end of cocking handle 58 and extended therefrom by a compression spring 146 is a stop 62. Spring loaded stop 62 in the bottom of cocking handle 58 bears against an upper arm 64 of piston 32 driving it to the left of FIG. 1*a*. As before, the entire piston mechanism 32 is forced left when cocking handle 58 is moved back, thereby ultimately moving bolt 28 down to the loading position. Stop 62, however, slides upwardly on a fixed inclined ramp 66 until it is moved past a locking pin 68, which slides transversely across the face of upper arm 64 of piston 32, thereby locking piston 32 in the rearward position.

Figure 3:
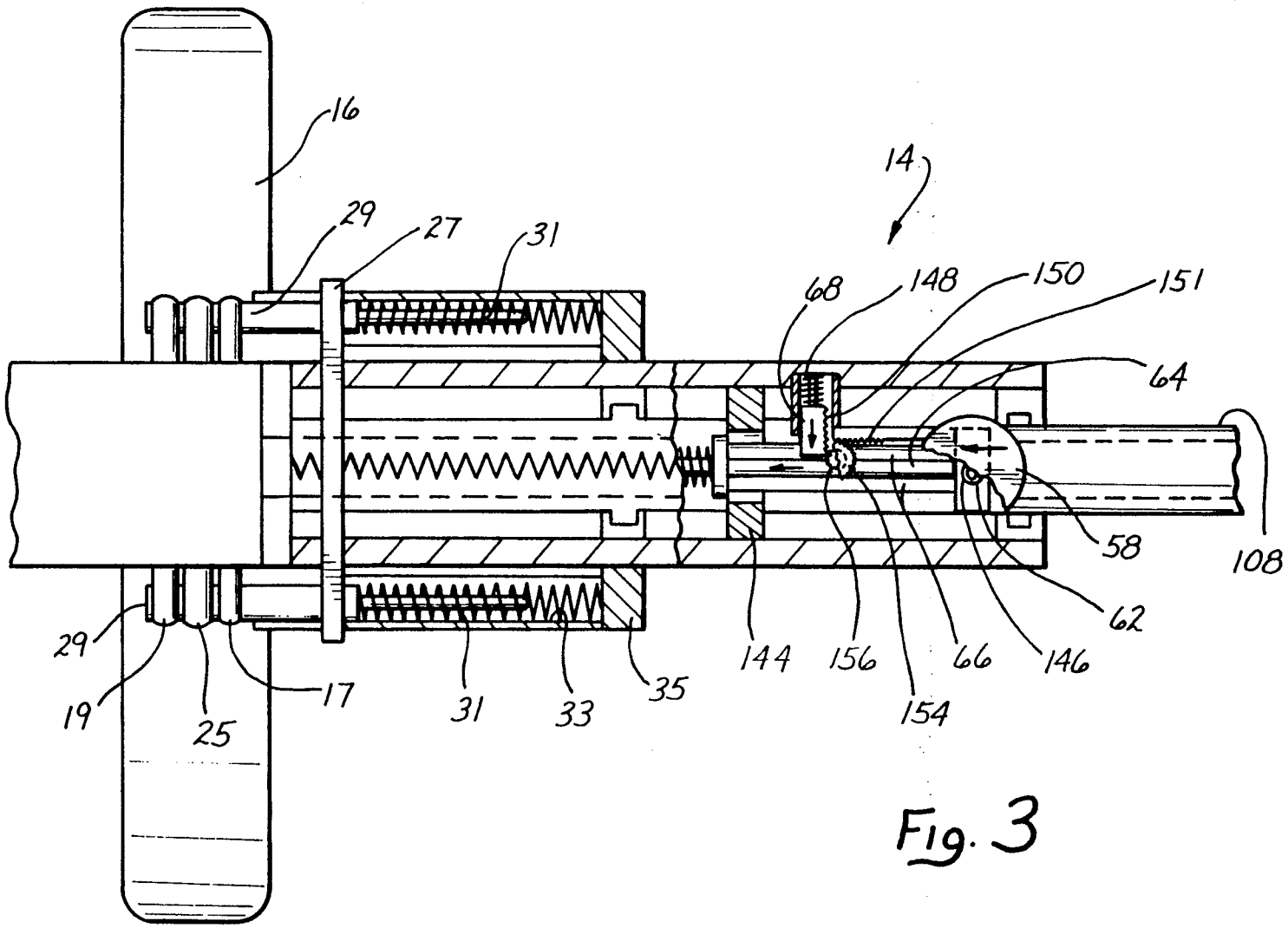
FIG. 3 is a simplified diagrammatic depiction of the cocking mechanism of the gun and the attachment mechanism for the drum magazine to the rifle body as shown from a top view and as is illustrated in FIG. 1*a*.

FIG. 3, which is a top plan view of rifle body 14, shows greater detail in connection with the mechanism just described. Locking pin 68 is spring loaded by a compression spring 148 and has a gear rack 150 defined on its forward edge as seen in FIG. 3. Cocking handle 58 also includes a gear rack 151 which engages the head of a geared pin 152. The upper portion of geared pin 152 has a gear head 154. The lower portion or body of pin 152 is provided with a cylindrical geared surface 156. The cylindrical body of gear 156 then engages the gear rack 150 in locking pin 68. The rearward motion of cocking handle thereby causes rack 150 to rotate gear pin 152 by virtue of the coupling of gear head 154 with gear rack 150. Gear pin 152 rotates and through rotation of cylindrical geared body 156 causes locking pin 68 to move into the locked position just as spring loaded stop 62 has moved behind it.

Cocking handle 58 may continue to be moved rearward (to the left of FIG. 1*a*) whereupon it engages actuator arm 144 allowing projectile 106 in loading position 126 to be moved rearwardly into breech 138 by the rearward movement of ramming piston 52. Meanwhile, locking pin 68 is transversely disposed across the face of extension 64 of piston 32 causing bolt 28 to be locked in the downward or receiving position within the gun.

Upon release of cocking handle 58, spring 60 will drive cocking handle forward (to the right of FIG. 1*a*) causing gear rack 150 to engage gear pin 152, withdrawing locking pin 68, and thereby releasing upper arm 64 of piston 32 to allow compression spring 56 to drive piston 32 forward and ultimately causing block 28 to be driven upward into the firing position as depicted in FIG. 1*a*.

Firing of the gun is controlled by electronic circuit 70 which is a conventional microprocessor circuit having stored therein a program for appropriate operation of rifle body 14. Circuit 70 may be configured by depression of push button switches to operate in one of a multiple number of modes, including automatic fire, semi-automatic fire, a cleaning mode, or in a disabled safety status. Electronic circuit 70 controls various valves shown in FIGS. 1*a* and 1*b* as described below in order to inject a predetermined amount of propellent and oxidant on the pull of trigger 156.

Before considering the actual firing or launching process, consider the situation in which a round of projectile 106 is unloaded without being fired or launched. An unloading mechanism is provided by handle 78 shown in FIG. 1*a*, underneath the butt of rifle body 14. Handle 78 is rotated downwardly and then shoved or moved forward to drive spring loaded rod 80 into bolt 28, when bolt 28 is positioned in the downward or receiving position. Rod 80 drives projectile 106 from breech 138 back into loading position 126 within magazine 16. It is also possible that magazine 16, which is bolted by quick release bolts to rifle body 14, may be removed so that the projectile is simply driven out of the loading port of the gun and can be retrieved.

Consider now in more detail the propellent pack of the gun as shown in FIG. 1*b*. Pack 10 which in the preferred embodiment is comprised of a composite KEVLAR, a trademark for a composite made from aramid fibers case 158 includes as tanks 100 and 104 containing collapsible bladders of propellent and oxidant respectively. A pressurization tank 160, filled with helium gas at approximately 2500 PSI, is coupled through two outlet ports 162 to corresponding pressure regulating valves 164 and 166. The output of pressure regulating valves 164 and 166 in turn are coupled to line pressure control valves 168 and 170 respectively. The output of line pressure control valves 168 and 170 in turn are coupled to check valves 172 and 174 respectively. Check valves 172 and 174 in turn are coupled to tanks 100 and 104 containing collapsible bladders of propellent and oxidant respectively. Therefore, the helium gas from tank 160 provides the pressurized means for forcing the components from tanks 100 and 104.

The output of tanks 100 and 104 in turn are solenoid controlled operated ball valves 176 and 178 respectively. Valves 176 and 178 are shown in FIG. 1*b* as diagrammatically being operated by a solenoid 180. Solenoid 180 is coupled to circuit 70 in a conventional manner for overall control of the system.

Propellant is thus supplied from tank 100 and valve 176 through line 182. Similarly, oxidant is supplied through line 184. Lines 182 and 184 in turn are coupled to solenoid controlled ball valves 186 and 188 respectively. Ball valves 186 and 188 are shown as being diagrammatically controlled by solenoid 190. Again, solenoid 190 is controlled by circuit 70 and coupled thereto.

Propellent and oxidizer are then provided via lines 192 and 194 respectively coupled to ball valves 196 and 198 in the base of hand grip 200 of rifle body 14 seen in FIG. 1*a*. Valves 196 and 198 in turn are controlled by solenoid 202 which is also controlled by circuit 70. The oxidant and propellent are then supplied to high speed ball valves 204 and 206 respectively. Ball valves 204 and 206 in turn are controlled by solenoid 208 under the master control of circuit 70. The output of valves 204 and 206 are provided to helium injection valves 210 and 212 respectively. When it is desired to supply oxidant and propellent to combustion chamber 102, the oxidant or propellent is coupled through valves 210 and 212 respectively to ball valves 214 and 216 respectively. Ball valve 214 is controlled by solenoid 218 while ball valve 216 is controlled by solenoid 220. Solenoids 218 and 220 are each connected to a control by circuit 70. The oxidant and propellent will then be injected through a mixing nozzle 222 into the rear portion of combustion chamber 102 as controlled by the various valves previously described and circuit 70. When the propellent and oxidant combine in combustion chamber 102, a forceful explosion occurs which propels projectile 106 positioned in breech 138 at the end of combustion chamber 102 adjacent orifice 224. Orifice 224 is downstream from a nozzle 226 placed within combustion chamber 102 at its narrowed neck and serves to further increase velocity of the combusted propellants.

After the firing or launching sequence is completed, it is sometimes desirable to cleanse the line and combustion chamber 102 of oxidant and propellent to prevent effects of the corrosive action of these components or their combination. For this purpose, a second helium tank 228 is provided in pack 10 for storing helium at approximately 3500 PSI. The helium is provided through a pressure regulator valve 230 through a line pressure control valve 232 to check valve 234 as seen in FIG. 1*b*. Check valve 234 in turn is controlled by solenoid 236 coupled to circuit 70. Pressurized helium is then directed to a ball valve 238 controlled by solenoid 190. The helium is then provided on line 240 to a disconnect coupler 242 in the butt of hand grip 200. From coupler 242, an interior line 244 continues through hand grip 200 into rifle body 14 to helium injection valves 210 and 212 seen in FIG. 1*a*. Helium injection valves are controlled by solenoid 208 to inject helium under pressure into line 246 and 248 to flush the oxidant and propellent thereform. In the same manner, helium is provided to combustion chamber 102 to flush the chamber as well as breech 138 and barrel 108.

In addition to helium flushing provided within the gun, a number of vacuum purge nozzles are provided in various ball valves throughout the system to allow oxidant and propellent which may be left in the gun to be evacuated for the purposes of cleaning and maintenance. For example, in the illustrated embodiment, ball valves 214, 216 which provide propellent and oxidant to mixing nozzle 222 at the rear of combustion chamber 102 are each also provided with vacuum purge nozzles 282. Similar vacuum purge nozzles 284 are provided for ball valves 176 and 178 within pack 10.

Combustion chamber 102 is included within a heat resistant insulating ceramic casing 250. A steel water jacket 252 is then provided within or around ceramic casing 250 around combustion chamber 102 to carry away excess heat generated in combustion chamber 102 and transferred walls 254 of combustion chamber 102. FREON, a trademark for a fluorocarbon refrigerant or another heat exchanging coolant fluid is drawn into rifle body 14 through line 256 coupled to ball valve 258 at the base of hand grip 200.

Cooling fluid in line 256 is then provided to cooling jacket 252 which is in a heat exchanging relationship with walls 254 of combustion chamber 102. The fluid is then pumped by block 28 in a manner described below, out of cooling jacket 252 into a rearward first pumping chamber 38.

The cooling fluid is drawn into a first pumping chamber 38 positioned above and partly defined in bolt 28. A tube 39 telescopically extends into chamber 38 from bolt 28. Tube 39 communicates with a cooling passage way 41 defined within block 28 which brings the cooling fluid into a heat exchanging relationship with breech 138. The cooling fluid is then supplied to a second pumping chamber 40 into which a tube 43 is also telescopically disposed to form a pumping piston.

Fluid is allowed to enter pumping chamber 38 by means of butterfly valve 45 at the inlet to pumping chamber 38, but is not allowed to escape thereform. Therefore, as block 28 is driven downwardly, tubes 39 and 43 are pulled telescopically downwardly within chambers 38 and 40 respectively thereby drawing in a charge of cooling fluid into block 28. When block 28 is driven upwardly, the force of the outwardly rushing fluid quickly closes butterfly valve 45 prohibiting further escape of fluid from block 28 and pumping the fluid within duct 41 and pumping chambers 38 and 40 through the outlet of chamber 40 into an exhaust line 260 directed downwardly within hand grip 200 of rifle body 14. Exhaust line 260 is then connected to a ball valve 262.

The heated cooling fluid is then coupled by means of ball valve 262, which is also controlled by solenoid 202 to a return line to pack 10. The incoming fluid is connected to ball valve 266 controlled by solenoid 190. The fluid flows from ball valve 266 to a fluid-to-air heat exchanger, generally denoted by reference numeral 268. Heat exchanger 268 is comprised of a serpentine heat exchange coil 270 contained within an air manifold 272. Cool outside air is delivered through intake 274 by means of fan 276 to one end of air manifold 272. The air then flows through air manifold 272 in a heat exchanging relationship with the heated cooling fluid contained within cooling coils 270 to an exhaust outlet 276. The now cooled coolant fluid is returned to ball valve 278 controlled by solenoid 190. The cooled return fluid is then delivered along the line 280 to ball valve 258 for recirculation as a closed loop system through rifle body 14.

The launch of each projectile 106 is, of course, accompanied by a recoil force applied to rifle body 14. Therefore, the butt of the gun, generally denoted by reference numeral 286, is provided with a hydraulic damper which is comprised of a reservoir 73 of hydraulic fluid which flows outwardly through a one-way valve 72. Viscosity of the fluid and the resistance of valve 72 provide a controlled measure of high energy absorption to the impulsive recoil. The hydraulic fluid, which then flows through valve 72 into compression reservoir 73, is returned to the original reservoir 73 through a plurality of one-way valves 74, which provide low resistance to reverse flow.

The butt 278 of rifle body 14 is formed like a reciprocating cylinder which is telescopically disposed within a receiving casing 288. Reservoir 73 is defined between casing 288 in the bottom structure of butt 286 in which valve 72 and 74 are disposed. A plurality of springs 76 bear against the inner surface of butt 286 resiliently urging butt 286 to the rear (to the left as shown in FIG. 1). Impulsive recoil causes butt 286, acting as piston, to be compressed against springs 76 against the dampening effect of fluid within reservoir 73. Springs 76 restore butt 286 to its original configuration as permitted by the easy return flow through valves 74.

When a projectile 106 is fired, it passes through a muzzle brake and flash hider, generally denoted by reference numeral 42. Escaping gas goes forwardly through directed ducts 44 at the end of gun barrel 108. The forwardly directed gas pressure bears against baffles 46 providing some cushioning against the recoil. The flash of the burning propellent is hidden by stainless steel mesh screen 48 to minimize flash, which would otherwise plume brilliantly.

Magazine 16 is coupled to rifle body 14 as best depicted in FIG. 3. Magazine 16 has two extending flanges 17 and 19 extending from each side of delivery position 126. Each flange 17 and 19 is fitted with a top fitting having a bore 23 defined therethrough. A corresponding fitting 25 is shown in FIG. 3 which extends from the body of rifle body 14. Drum 16 is then placed upwardly against the body of rifle body 14 so that gun fitting 25 is positioned between flanges 19 and 17 extending from drum 16. A spring-loaded bracket then extends a pair of parallel pins 29 through aligned bores 23 into flanges 17, 19 and fitting 25. Pins 29, which are ganged together by bracket 27, are maintained in extended position locking drum 16 to rifle body 14 by means of a pair of compression springs 31 captured within channels 33 within magazine fixture 35. Drum magazine 16 can be quickly detached and a new drum attached by simply grasping bracket 27, which extends over the body of rifle body 14 as shown in FIG. 1*a*, and pushing bracket 27 forward thereby withdrawing pins 29 from bores 23. Attachment and alignment to a new drum 16 is then assured by reengagement of pins 29 through bores 23 in flanges 17, 19 and fitting 25 by the release of bracket 27.

Many alterations and modifications may be made by those having ordinary skill in the art without departing from the spirit and scope of the invention. Therefore, it must be understood that the illustrated embodiment has been set forth only for the purposes of example and should not be taken as limiting the invention defined by the following claims. The elements of the invention as described above must be read to include not only the means specifically illustrated in the specification and means equivalent thereto, but all means now known or later devised for performing substantially the same function in substantially the same way to obtain substantially the same result or which use means which fall within the spirit of the present teachings.

I claim:

1. A liquid propellent gun for the launching of rocket propelled projectiles comprising:

rifle means for launching said projectiles, said rifle means comprising a barrel through which said projectiles are launched and a combustion chamber coupled to said barrel for igniting and launching said projectiles through said barrel;

propellent means for providing a plurality of liquid propellent components to said rifle means for combination within said combustion chamber, cooling means for cooling said combustion chamber within said rifle means, said cooling means comprising a closed loop cooling system; and wherein said closed loop cooling system is comprised of a pump within said rifle means, a closed circuit at least partly within said rifle means, said closed circuit in heat exchanging relationship with said combustion chamber, a liquid cooling fluid disposed in said closed circuit and pumped therethrough by said pump, and heat exchanging means for transferring heat out of said cooling fluid; and wherein said heat exchanging means is disposed within said propellent means, said heat exchanging means comprising an air-to-cooling fluid heat exchanger, whereby high velocity projectiles are launched from a light weight gun.

2. A liquid propellent gun for the launching of rocket propelled projectiles comprising:

rifle means for lauching said projectiles, said rifle means comprising a barrel through which said projectiles are launched and a combustion chamber coupled to said barrel for igniting and launching said projectiles through said barrel;

propellent means for providing a plurality of liquid propellent components to said rifle means for combination within said combustion chamber; and cooling means for cooling said combustion chamber within said rifle means, said cooling means comprising a closed loop cooling system, wherein said closed loop cooling system is comprised of a pump within said rifle means, a closed circuit at least partly within said rifle means, said closed circuit in heat exchanging relationship with said combustion chamber, a liquid cooling fluid disposed in said closed circuit and pumped therethrough by said pump, and heat exchanging means for transferring heat out of said cooling fluid; and wherein said rifle means further comprises a reciprocating block having a breech defined therein, said projectiles being disposed within said breech and launched therefrom through said barrel, said reciprocating block having defined therein at least one piston chamber, said reciprocating block and piston chamber comprising said pump, whereby high velocity projectiles are launched from a light weight gun.

3. The gun of claim 2 further comprising a reciprocating piston operatively communicated with said barrel for the supplying gas pressure from said barrel to drive said piston, said gas driven piston being coupled to said block to cause said block to reciprocate.

4. The gun of claim 2 wherein said rifle means further comprises a gas driven loading rod for disposing said projectiles into said breech of said block, said loading rod being operatively communicated with said barrel to provide gas pressure for driving said loading rod.

5. A liquid propellent gun for the launching of rocket propelled projectiles comprising:

rifle means for launching said projectiles, said rifle means comprising a barrel through which said projectiles are launched and a combustion chamber coupled to said barrel for igniting and launching said projectiles through said barrel; and propellent means for providing a plurality of liquid propellent components to said rifle means for combination within said combustion chamber, wherein said rifle means further comprises a reciprocating block having a breech defined therein, said projectiles being disposed within said breech and launched therefrom through said barrel, said reciprocating block having defined therein at least one piston chamber, said reciprocating block and piston chamber comprising a pump, and further comprising cooling means for cooling said rifle means, said cooling means comprising a closed loop cooling system containing coolant fluid, said coolant fluid being pumped through said cooling means and said rifle means by said pump.

whereby high velocity projectiles are launched from a light weight gun.

6. The gun of claim 5 further comprising a cocking means for manually disposing one of said projectiles into said breech of said block and for reciprocating said block from a loading position to a launching position.

7. The gun of claim 5 further comprising an unloading means for manually disposing one of said projectiles from said breech of said block from said rifle means without launch of said projectile.

8. The gun of claim 5 wherein said rifle means further comprises a spiral magazine for storing a plurality of said projectiles, said spiral magazine comprising a drum casing in which said plurality of projectiles are slidingly disposed in a spiral pattern, a push rod for urging said spiral pattern of projectiles from said drum casing and motive means coupled to said push rod for applying a force to said push rod to urge said projectiles from said magazine, said motive means being coupled to said reciprocating block so that advancement of one of said projectiles from said spiral magazine into said rifle means is synchronized with motion of said reciprocating block.

9. The gun of claim 5 wherein said rifle means further comprises a butt, said butt comprising a fluidic shock absorbing means for absorbing recoiled energy and parted to said rifle means by launch of said projectile.

10. The gun of claim 5 wherein said rifle means further comprises muzzle brake means coupled to said barrel so that escaping gas from said barrel into said muzzle brake means generates a braking force opposing recoil of said rifle means upon launch of said projectile.

11. The gun of claim 10 wherein said muzzle brake means further comprises flash hiding means for visually hiding flash of gas escaping from said barrel upon launch of said projectile from said rifle means.

12. The gun of claim 5 further comprising means for disposing one of said rocket propelled projectiles into said rifle means in preparation for launching.

13. The gun of claim 5 further comprising means for unloading an unlaunched one of said rocket propelled projectiles from said rifle means from a position of launch to a position where launch is not possible, leaving said rifle means in a configuration wherein no one of said rocket propelled projectiles is ready for launch.

14. The gun of claim 5 wherein said rifle means comprises a magazine for storing a plurality of said rocket propelled projectiles and wherein said reciprocating block comprises means for automatically disposing successive ones of said rocket propelled projectiles from said magazine into said rifle means in preparation for successive launch, said rifle means for automatically launching successive ones of said rocket propelled projectiles.

15. The gun of claim 5 further comprising means for quickly disconnecting said magazine from said gun with a single manual movement.

16. The gun of claim 5 wherein said propellant means is separately provided to said gun from said rifle means and further comprises means for quickly disconnecting said propellant means from said rifle means and reconnecting a new propellant means to said rifle means.

17. The gun of claim 5 further comprising means for visually hiding flash and muffling sound from said rifle means when one of said rocket propelled projectiles is launched therefrom.

18. The gun of claim 5 wherein said rifle means has a butt end to facilitate carrying and aiming thereof and further comprising means for absorbing recoil shock from said rifle means when one of said rocket propelled projectiles is launched therefrom by absorbing said recoil shock in a hydraulic dampener disposed within said butt end of said rifle means.

19. A method for launching rocket propelled projectiles in a hand held gun comprising the steps of;

feeding a projectile from a magazine into a breech of a reciprocating block;

disposing said block into a launching position adjacent a combustion chamber;

providing said combustion chamber within said gun with a plurality of liquid propellent components, said liquid propellent components, when being combined, violently exploding within said combustion chamber;

simultaneously igniting said rocket propelled projectile and projecting said projectile from said combustion chamber through a barrel of said gun;

reciprocating a breech block during the sequential steps of feeding projectiles, disposing said projectiles, providing liquid components to said combustion chamber and simultaneously igniting when projecting said projectiles through said barrel, reciprocation of said breech block pumping a cooling fluid through said breech block, and further circulating pumped cooling fluid through a cooling jacket around said combustion chamber; and transferring heat from said cooling fluid obtained from said breech block of combustion chamber to ambient air through a portable cooling pack, whereby high velocity projectiles are launched from a light hand held rifle.

* * * * *